US006612781B1

(12) United States Patent
Jackson

(10) Patent No.: US 6,612,781 B1
(45) Date of Patent: Sep. 2, 2003

(54) METHOD OF TRANSPORTING AND INSTALLING AN OFFSHORE STRUCTURE

(75) Inventor: Gordon Jackson, London (GB)

(73) Assignee: Ove Arup Partnership Limited, London (GB)

( * ) Notice: Subject to any disclaimer, the term of this patent is extended or adjusted under 35 U.S.C. 154(b) by 0 days.

(21) Appl. No.: 09/530,398

(22) PCT Filed: Oct. 30, 1998

(86) PCT No.: PCT/GB98/03243

§ 371 (c)(1),
(2), (4) Date: Jul. 10, 2000

(87) PCT Pub. No.: WO99/22985

PCT Pub. Date: May 14, 1999

(30) Foreign Application Priority Data

Oct. 31, 1997 (GB) ..... 9723098

(51) Int. Cl.[7] ..... E02B 17/02; B63B 35/00
(52) U.S. Cl. ..... 405/209; 405/205
(58) Field of Search ..... 405/203, 205, 405/206, 209

(56) References Cited

U.S. PATENT DOCUMENTS

| | | | | | |
|---|---|---|---|---|---|
| 3,716,994 | A | * | 2/1973 | Pogonowski | 405/204 |
| 3,797,438 | A | * | 3/1974 | Fayren | 114/77 R |
| 3,859,806 | A | * | 1/1975 | Guy et al. | 114/77 A |
| 3,977,346 | A | * | 8/1976 | Natvig et al. | 405/203 |
| 4,167,148 | A | * | 9/1979 | Fayren | 114/265 |
| 4,170,186 | A | * | 10/1979 | Shaw | 114/264 |
| 4,252,469 | A | * | 2/1981 | Blight et al. | 405/204 |
| 4,360,291 | A | * | 11/1982 | Cranberg et al. | 405/205 |
| 4,648,751 | A | * | 3/1987 | Coleman | 405/209 |
| 4,714,382 | A | * | 12/1987 | Khachaturian | 405/209 |
| 5,219,451 | A | * | 6/1993 | Datta et al. | 405/203 |
| 5,407,302 | A | * | 4/1995 | Springett et al. | 405/209 |
| 5,522,680 | A | * | 6/1996 | Hoss et al. | 405/209 |
| 5,525,011 | A | * | 6/1996 | Hunag | 405/223.1 |
| 5,542,783 | A | | 8/1996 | Pollack | |
| 5,741,089 | A | * | 4/1998 | Gallaher et al. | 405/196 |
| 5,924,822 | A | * | 7/1999 | Finn et al. | 405/209 |
| H1815 | H | * | 11/1999 | Campbell et al. | 405/209 |
| 6,139,224 | A | * | 10/2000 | Michel et al. | 405/224 |
| 6,196,767 | B1 | * | 3/2001 | Thomas | 405/203 |
| 6,340,272 | B1 | * | 1/2002 | Runge et al. | 405/203 |

FOREIGN PATENT DOCUMENTS

| | | | | |
|---|---|---|---|---|
| GB | 631320 | | 8/1946 | |
| GB | 1 338 504 | | 11/1973 | |
| GB | 1 380 503 | | 1/1975 | |
| GB | 2009291 | | 6/1979 | |
| GB | 2099894 | | 12/1982 | |
| NL | 8801194 | | 12/1989 | |
| WO | WO 91/06714 | | 5/1991 | |
| WO | WO-93/00482 | * | 1/1993 | E02B/17/02 |

* cited by examiner

*Primary Examiner*—Robert E. Pezzuto
*Assistant Examiner*—Alexandra K. Pechhold
(74) *Attorney, Agent, or Firm*—Diederiks & Whitelaw, PLC

(57) ABSTRACT

A method of transporting and installing an offshore structure including transporting the offshore structure to the installation site by barge with at least a portion of the structure being supported under the barge, and lowering the offshore structure to the water bed. In accordance with a preferred embodiment, the structure includes a tower and a base, with the tower being mounted offset from a center of the base through the use of bolts.

23 Claims, 8 Drawing Sheets

METHOD OF TRANSPORTING AND INSTALLING AN OFFSHORE STRUCTURE

BACKGROUND OF THE INVENTION

1. Field of the Invention

The invention relates to a method of transporting and installing an offshore structure, such as an offshore production platform, in particular for oil or gas.

2. Discussion of the Prior Art

The offshore oil industry is highly competitive and therefore the cost of constructing, transporting and installing offshore structures is extremely important. Moreover, the cost of transporting and installing a platform may be even higher than its construction costs.

One known method of installing offshore platforms involves lifting the platform sections by a crane vessel and assembling them in situ. However this is expensive since it involves the long term use of installation vessels, which are expensive to hire. Another method involves building buoyancy tanks into a structure to allow it to be floated to its desired position and then ballasting the structure onto the water bed However this increases the cost of constructing the platform.

SUMMARY OF THE INVENTION

The present invention seeks to provide a method of transportation and installation which is both simple and which is less expensive than known methods.

From a first aspect, therefore, the invention provides a method of transporting and installing an offshore structure comprising transporting the offshore structure to the installation site by barge with at least a portion of the structure being supported under the barge, and lowering the offshore structure to the water bed.

Thus the invention contemplates supporting at least a part of a structure below a barge, conveying the structure to its installation site and then lowering the structure into position.

This method has several advantages over the known methods described above. Firstly, it allows a standard barge to be used for transportation purposes, which is extremely cost effective. A fully assembled structure may be transported to the installation site and no assembly of the structure need take place at the installation site. Furthermore, the structure may be simply lowered into position from the barge, avoiding the need for expensive machinery for lifting the is structure from the barge. Thus the method of the invention offers significant advantages over the known methods.

The structure may be supported to the barge in a number of ways. In the preferred method of attachment, the barge is floated into position over the structure and the structure then attached to the barge. Thus preferably, the structure is constructed in a dry dock which is then flooded and the barge is floated over the appropriate part of the structure.

Although it would be possible to suspend the structure below the barge, for stability reasons, the structure is preferably made fast with the barge. To this end, the barge is preferably lowered over the structure into contact with an upper surface thereof and the structure then made fast with the barge. It may be possible, for example, to lower the barge over the offshore structure by at least partially emptying the dry dock so that the barge sins with the sinking water level. However most simply, the barge is ballasted down to the structure. The barge and structure are then attached to each other.

The structure and barge may be attached to each other by any means, for example by welding. Preferably however the offshore structure is attached and tensioned to the barge by standard cables using jacking means. The tensioning of the barge to the structure allows relative movement between them during transportation to be minimised. In addition, as will be seen, the jacking means can also be used to lower the structure to the water bed at the installation site.

In a preferred embodiment the barge and offshore structure are towed to the installation site by tugs. It will however be appreciated that any means of conveying them to the installation site might be employed. For example, they could be self propelled.

It will be understood from the above that the method of the invention could be used to install many forms of offshore structure. However, it is expected to be most useful for the installation of offshore production platforms.

A preferred structure for installation by the invention comprises a base, preferably of concrete, which when installed rests on the water bed and a tower, preferably a steel tower extending upwardly from the base and mounting suitable topsides. In such a structure the base or a portion thereof is supported beneath the barge, and the tower extends to one side or end of the barge. Thus the base may extend either sideways or lengthwise underneath the barge.

To facilitate such an arrangement, the tower of the platform is preferably offset from the centre of the platform base Since standard platforms known in the art are conventionally constructed with their tower at the centre of the platform base, this arrangement is believed to be novel and inventive in its own right, so from a further aspect the invention also provides an offshore platform comprising a base and a tower wherein the tower is offset from the centre of the base.

In order to counter the pitching or rolling moment generated by the tower offset during transportation, and thus improve the stability of the barge and platform while being conveyed to the installation site, the base is preferably provided with a suitably positioned counterweight. The counterweight may conveniently be formed as an upstand formed over part of the platform base. This may be sized and positioned such that when the platform is supported to the barge, it extends up the side of the barge opposite the side over which the tower extends.

In an alternative arrangement, when the base extends lengthwise under the barge however, the length of the base itself will act, to some extent as a counterweight, obviating the need for an upstanding counterweight.

To assist in installation, a positioning means may be provided on the water bed prior to the installation. The positioning means could be installed by any method, for example, lifting it into place or piling offshore. However it is preferred that it is also installed by the method of the invention.

The positioning means preferably comprises a large mass, for example of concrete, dimensioned to resist the forces generated during installation of the platform and having guide means for engagement with cooperating guide means on the platform.

As in the present invention, the base is held underneath the barge during transportation, the buoyancy of the structure is provided by the barge. Therefore, the thickness of the concrete base may be minimised to that required in the installed condition. However, traditionally the steel tower of an offshore structure is attached to the concrete base by being cast into the concrete during manufacture of the base. This method of attachment, however, requires the concrete base to have a thickness of at least 2 to 3 times the diameter of the steel tower Such a method is not, therefore, suitable for towers with relatively thin bases.

Thus in a preferred structure of the invention, the tower is attached to the base by bolting, most preferably by bolts extending upwardly from the base.

This method is believed to be novel and inventive in its own right. Thus, from a still further aspect, the present invention provides an offshore structure comprising a base and a tower extending upwardly therefrom, wherein the tower is attached to the base by bolts, most preferably by bolts extending upwardly from the base.

In this method, the bolts may be securely fastened in the base, for example by being pre-cast into the base or by being grouted into bores provided in the base, and the tower then assembled over the upstanding bolts and fastened into position. To maximise the strength of the mounting, the mounting bolts preferably extend substantially through the base.

To prevent corrosion, the portions of the bolts extending above the base may be coated with a suitable resistant coating.

The base of the tower is preferably formed with a fastening flange extending radially outwardly therefrom, for receiving the bolts. Most preferably circumferential stiffening ribs are provided between the flange and the tower to provide rigidity in that region, and bolt receiving holes are formed in the flange in the pockets defined between adjacent stiffening ribs.

In assembling the tower, the tower base flange may be assembled over the upstanding bolts, with a layer of grout positioned between the tower base flange and the upper surface of the concrete base to provide a satisfactory seating for the flange on the concrete base. An anchor block may then be positioned over the ends of the bolts to rest on the flange. An epoxy seating or the like may be provided for the block so as to prevent ingress of water to the bolt, thereby preventing corrosion.

After nuts have been tightened onto the bolts to securely attach the tower to the base, an enclosure may be defined around the nut and exposed bolt, which is filled with epoxy or some other sealant, again to prevent corrosion.

It will be appreciated that the tower need not be completely prefabricated before it is attached to the base. Only a tower base part need be constructed and attached and further tower sections then attached to the tower base part, for example by welding.

BRIEF DESCRIPTION OF THE DRAWINGS

A preferred embodiment of the invention will now be described, by way of example only, and with reference to the accompanying drawings in which.

DETAILED DESCRIPTION OF THE PREFERRED EMBODIMENT

Figure 1:
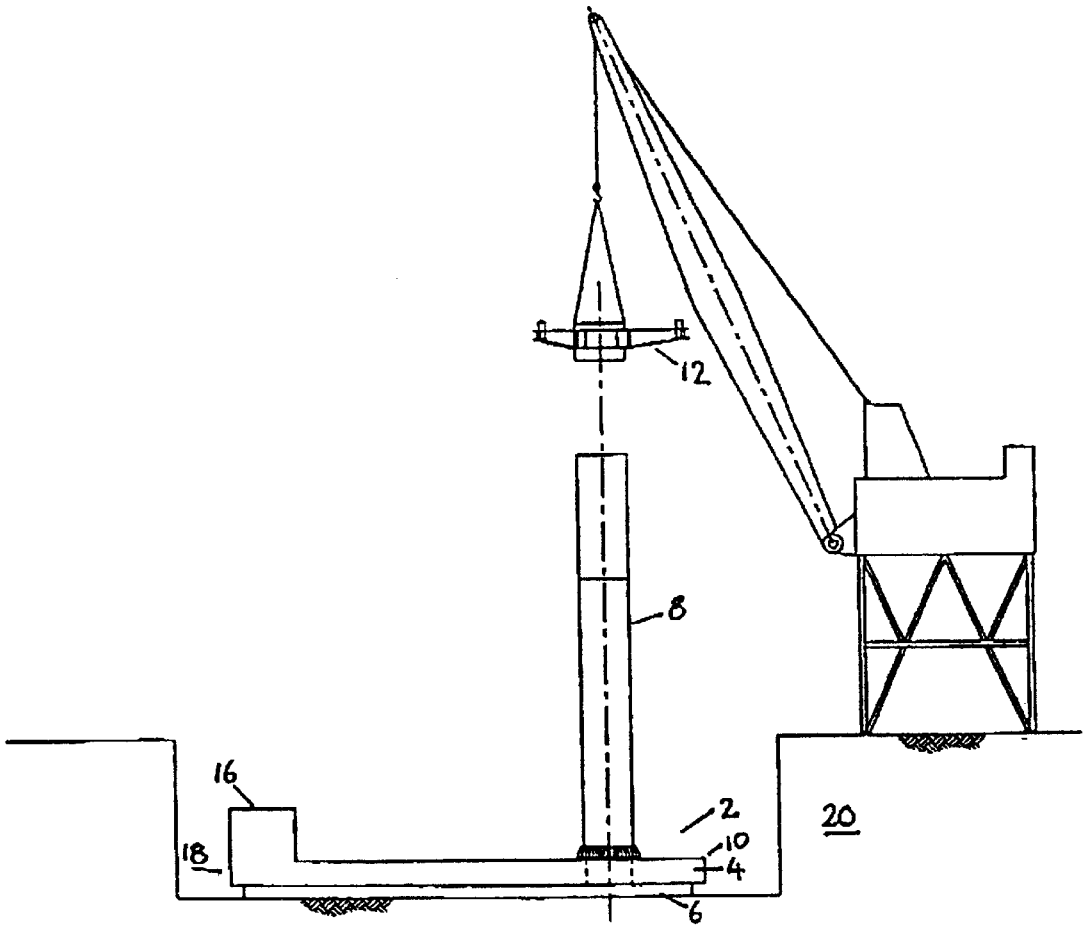
FIG. 1 is a schematic representation of a first stage of an installation sequence for an offshore platform.

Referring to the Figures, an offshore platform 2 comprises a generally rectangular concrete base 4 with a steel skirt 6 protruding downwardly therefrom for penetrating the sea bed. A steel tower 8 is mounted to the concrete base at one end 10 of the base 4, on the longitudinal axis of the base 4. The tower 8 is attached to the base 4 in any suitable manner but preferably by bolting as will be described further below. At the top of the tower 8 is mounted a support frame 12 with topsides 14. In addition, the concrete base 4 is provided with an upstanding integral concrete counterweight 16 extending from the other end 16 of the base 4. As can be seen from FIG. 5, the counterweight 16 extends across the complete width of the base 4.

Figure 2:
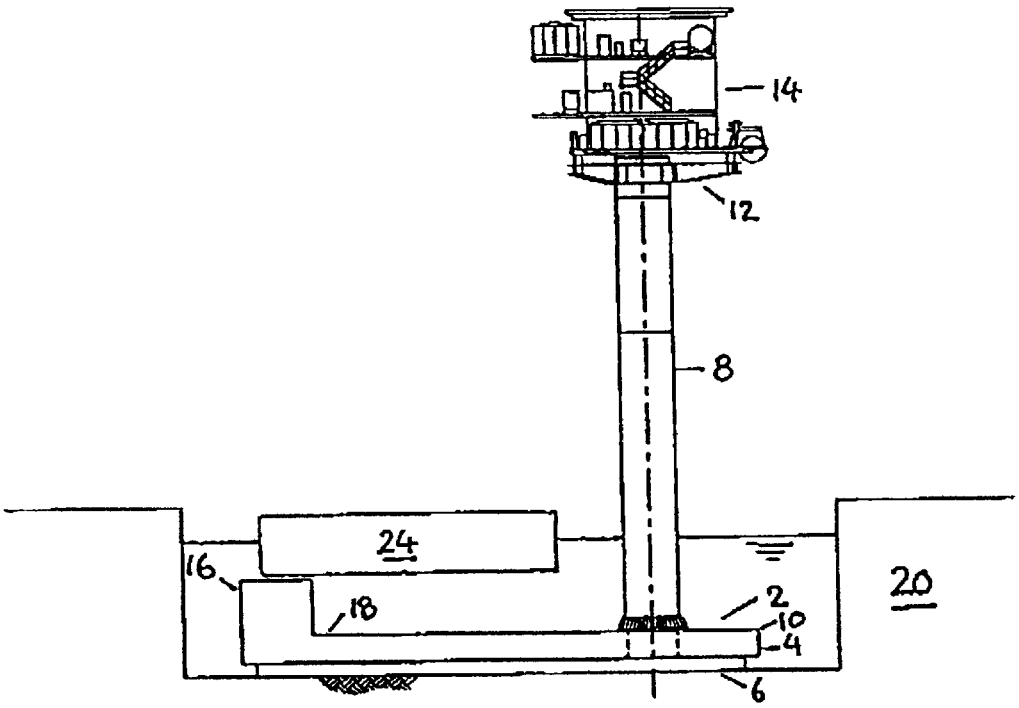
FIG. 2 is a schematic representation of a second stage of the installation sequence for an offshore platform.
Figure 3:
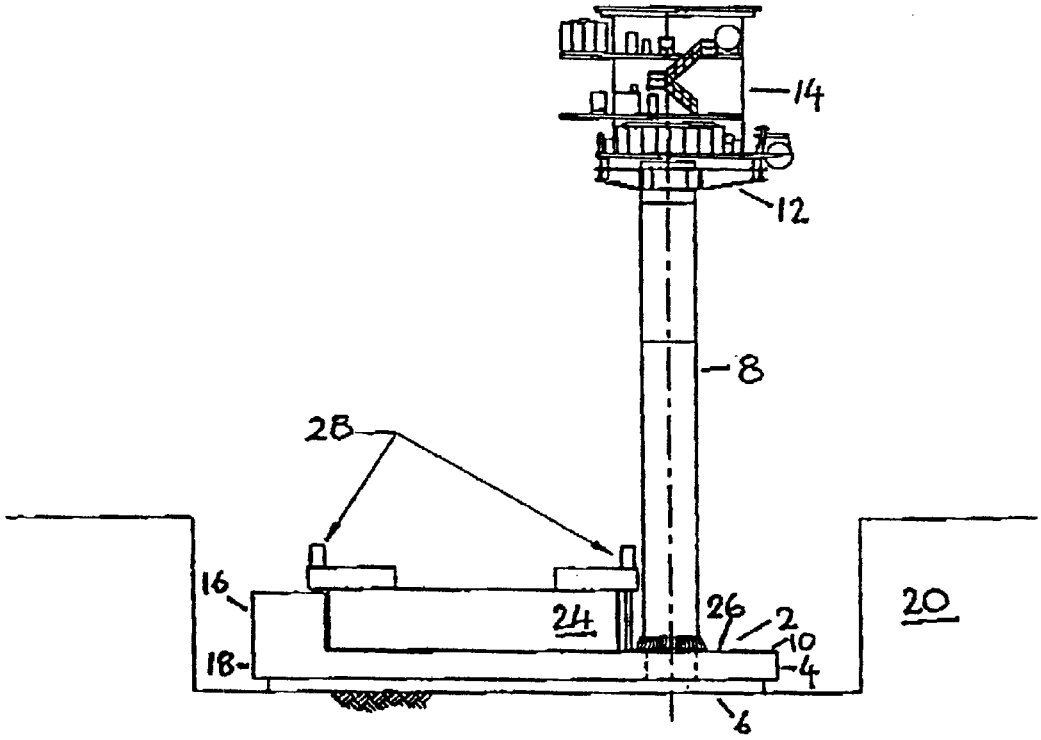
FIG. 3 is a schematic representation of a third stage of the installation sequence for an offshore platform.
Figure 4:
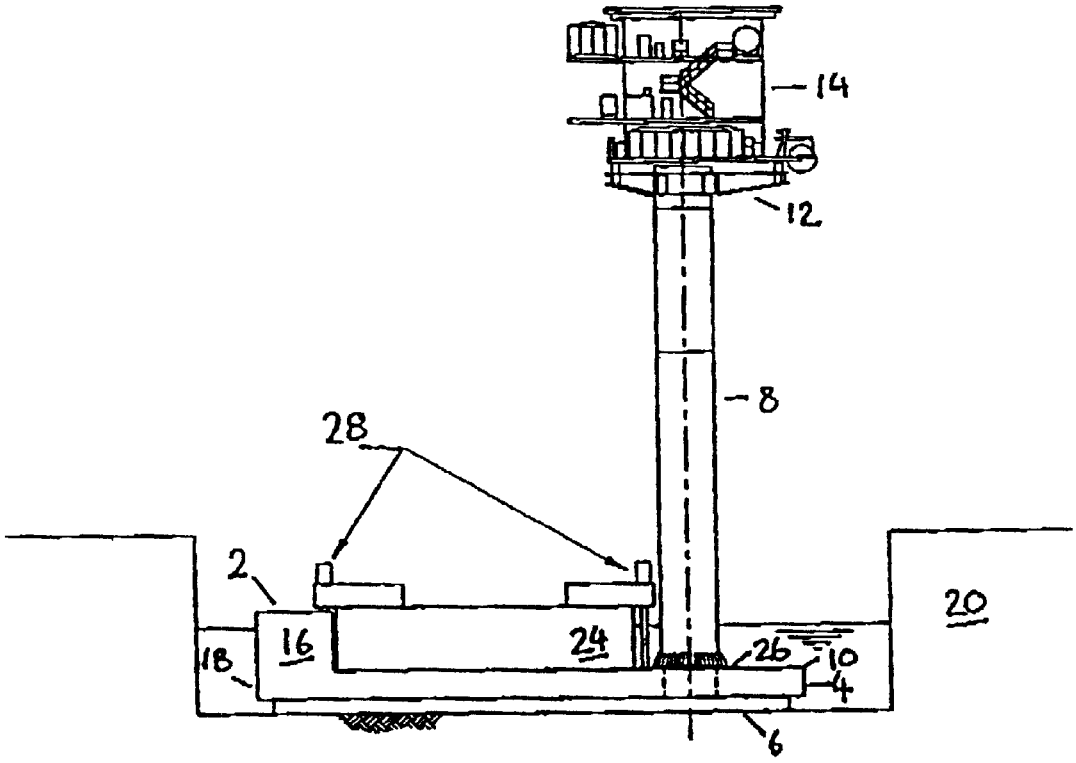
FIG. 4 is a schematic representation of a fourth stage of the installation sequence for an offshore platform.

The platform 2 is constructed essentially completely in a dry dock 20 using standard equipment. As shown in FIG. 2, once the construction phase is completed, the dry dock 20 is flooded, and a standard industry steel barge 24 is then floated and manoeuvred over the base 4 of the platform 2 so as to lie between the tower 8 and the counterweight 16. The barge 24 is of standard dimensions, and the relative positions of the tower a and the counterweight 16 are designed with such dimensions in mind such that, as shown in FIG. 3, the barge may be accommodated between the counterweight 16 and the tower 8.

Figure 5:
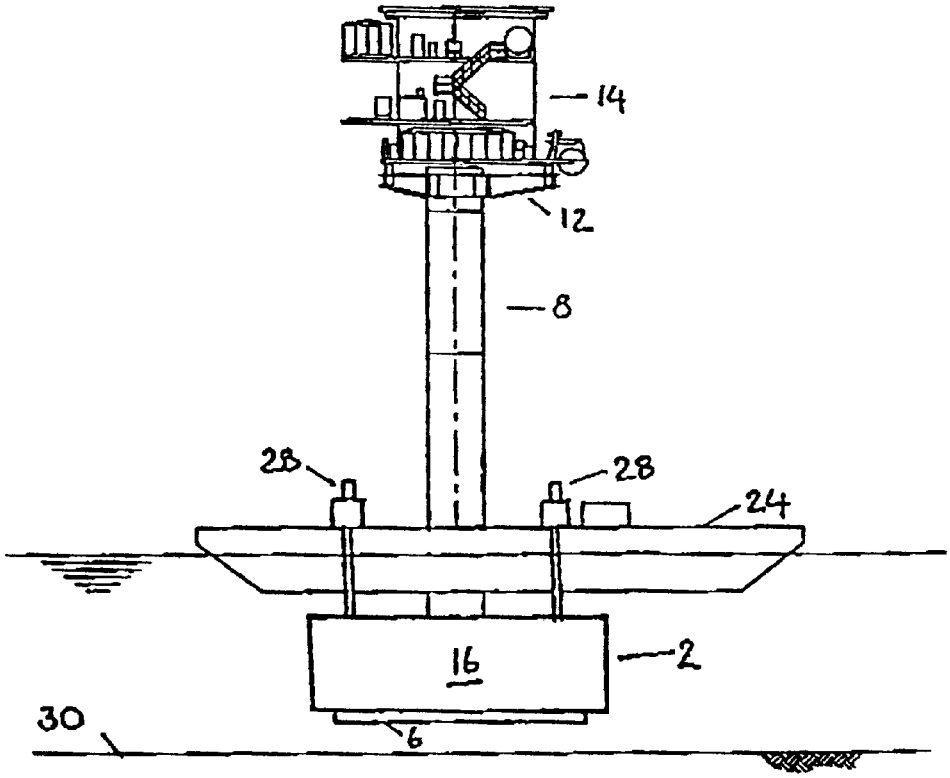
FIG. 5 is a schematic representation of a fifth stage of the installation sequence for an offshore platform.

When the barge is properly positioned over the base 4, the barge is ballasted down to rest on the upper surface 26 of the base 4. The base 4 is then connected to the barge 24 using four or more prestressing strands 28 which are positioned around the periphery of the barge as shown in FIGS. 3 and 5. As shown, the strands 26 extend over the side of the barge 24. Once the strands 28 are attached to the base 4, they are tensioned by strand jacks so as to hold the base 4 firmly to the underside of the barge 24.

The dock 20 is then reflooded, the barge level tried and the platform 2 then floated out of the dock 20 firmly attached to the barge 24. The platform is then towed to the installation site. As will be appreciated, the counterweight 16 counters the mass of the tower 8 during transportation to the installation site, thereby increasing the stability of the barge 24. It will also be appreciated that when installed, the counterweight will contribute to the anchoring of the structure to the water bed.

Figure 6:
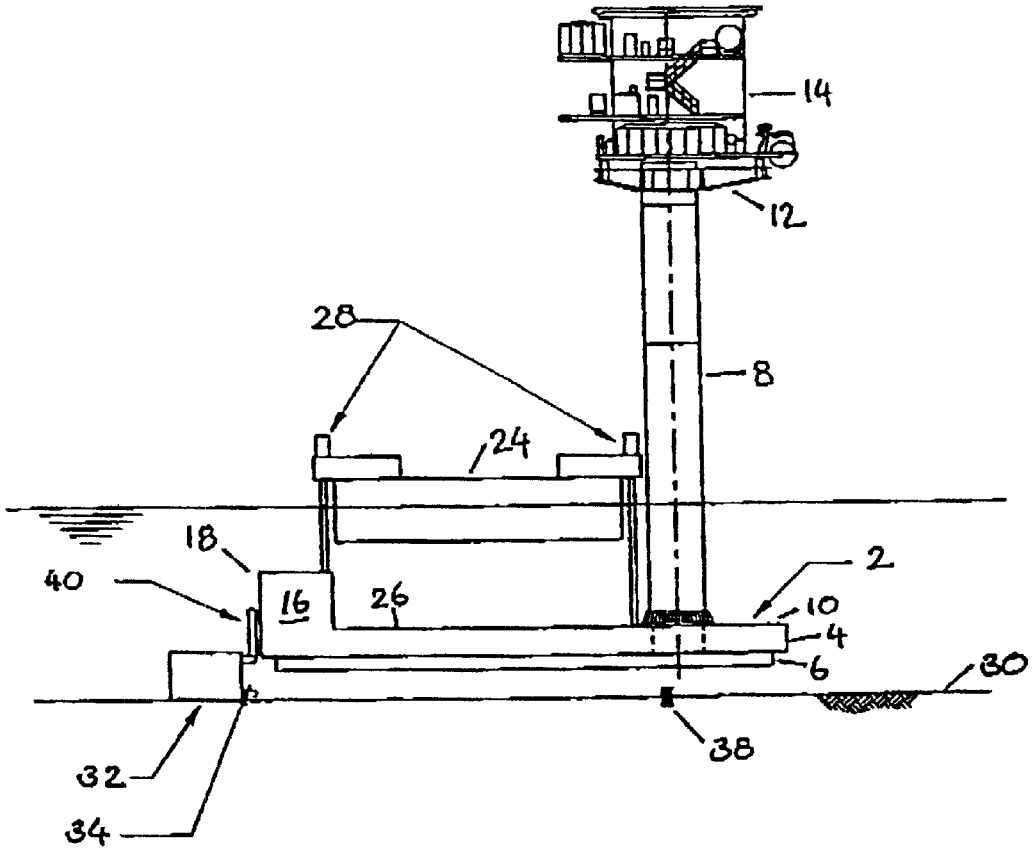
FIG. 6 is a schematic representation of a sixth stage of the installation sequence for an offshore platform.

As shown in FIG. 6, once the barge 24 is in the desired installation position, for example over a pre-drilled well head 38, the base 4 is lowered towards the seabed 30 using the jacks 28. Prior to installation of the platform, a positioning means 32 having guides 34 is positioned on the water bed 30. As shown in FIG. 6, the positioning means may simply be a large mass of concrete with suitable guide means 34 and which may itself have been installed by the method of the invention. During lowering, a guide 40 on the base 4 will engage in the guides 34 provided on the positioning means 32 so as to accurately position the base 4 on the water bed 30. The exact position of the guide 40 on the base 4 is pre-determined by measurement of the position of the guides 34 of the positioning means 32 relative to the well head 38. Once the skirts 6 penetrate the seabed 30 the weight of the base 4 is transferred to the seabed 30 and the base 4 is firmly secured allowing the strand jacks 28 to be disconnected.

Figure 7:
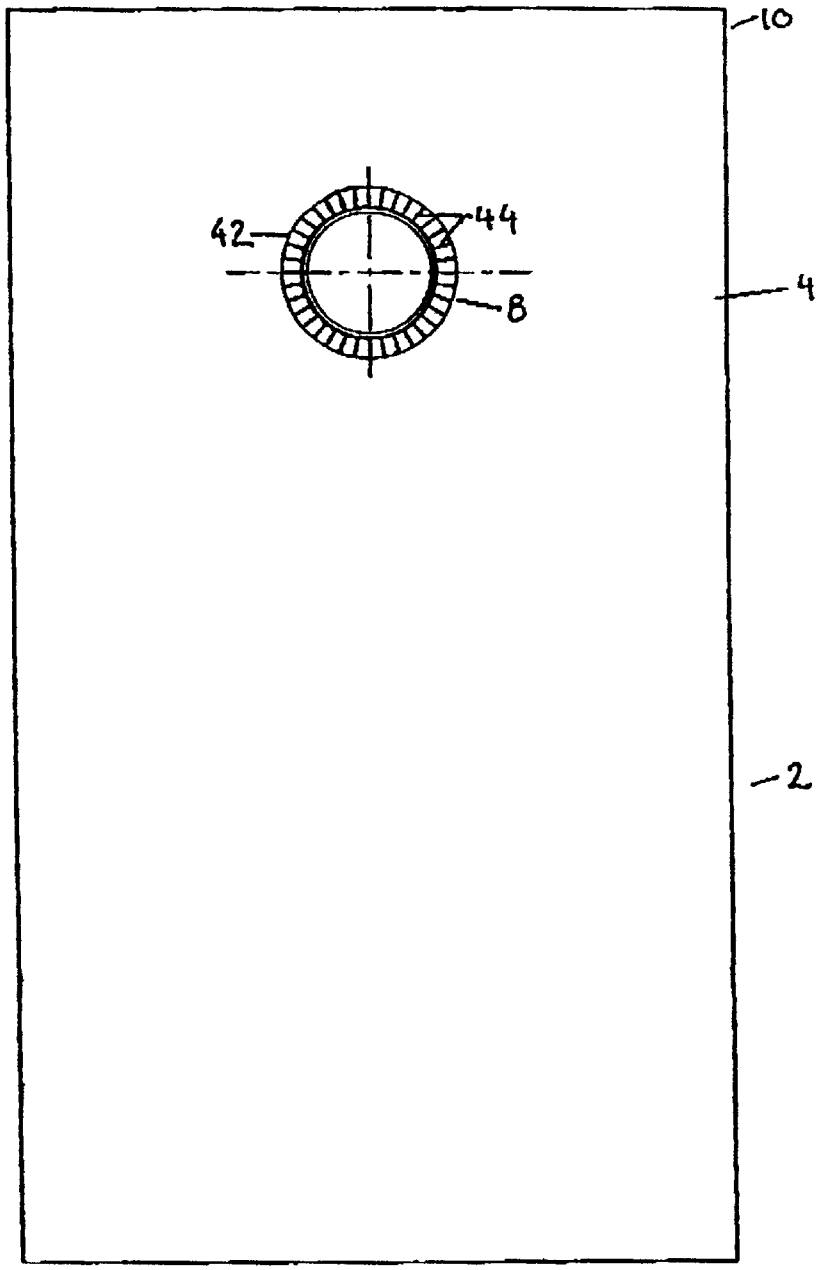
FIG. 7 is a plan view of an offshore platform of the invention.
Figure 8:
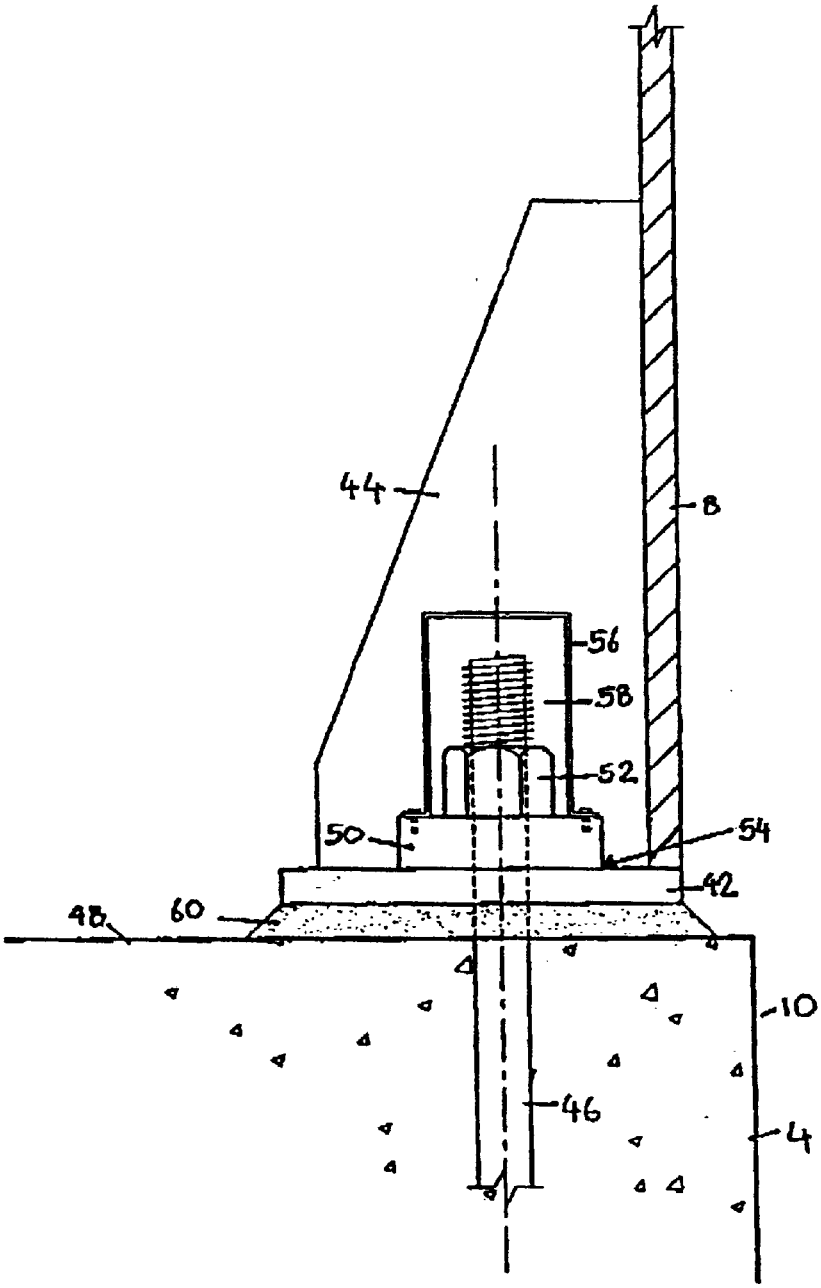
FIG. 8 is a sectional view showing the attachment method of the present invention.

As shown in FIGS. 7 and 8, the tower 8 of the offshore structure is attached to the base 4 by bolting. The tower comprises a radially outwardly extending flange 42 at its base, and 36 radially extending stiffening ribs 44 disposed about its circumference. In the particular embodiment shown, the tower diameter is about 3.8 m, the flange about 0.55 m wide and the ribs about 1 m high.

As shown more particularly in FIG. 8, bolts 46 are fixed into the concrete base 4, preferably extending substantially through the entire depth of the base 4 (about 2 m) so as to be held sufficiently firmly within the base. The bolts 46 may be grouted into pre-drilled holes in the base 4 but preferably, they are cast directly into the concrete. The bolts 46 are positioned so that they will pass through apertures formed in the flange 42 which are regularly spaced around the circumference of the tower 8 between each pair of stiffening ribs 44 when the tower is positioned on the base. Thus in this embodiment there are 36 bolts, each of which is about 2 m long and 75 mm in diameter.

The flange 42 of the tower 8 is secured to the upper surface 48 of the base 4 and the bolts 46 extend above the flange 42. A grout layer 60 is formed on the upper surface of the base 4 so as to provide an even seating for the flange 42 on the base. An anchor block 50 and nut 52 are then placed over each bolt 46 and the nuts tightened so as to hold the tower 8 to the base 4. An epoxy resin layer 54 is provided under the anchor block 50 so as to protect against corrosion. In addition, a cover 56 is attached over the projecting end of the bolt 46 and attached to the anchor block 50 so as to form an enclosure 58 which is also filled with epoxy resin. Thus, all exposed areas of the bolt 46 are protected against corrosion.

Preferably only a bottom segment of the tower a is initially bolted to the base 4. The other shaft segments which make up the tower may then be welded to this bottom segment.

It will be seen from the above description that the invention provides a method of installing an offshore structure which is simple to carry out and less expensive than existing methods. More specifically, the method of the invention requires neither the long term use of expensive installation equipment on site nor the construction of costly structures for the transportation and lowering of the offshore structure. This results in a very significant saving in the total cost of the construction and installation of an offshore production platform.

It will further be seen that the invention provides an alternative method of attaching a tower of an offshore structure to its base which allows the thickness of the base to be minimised so as to save on material costs.

The skilled person will appreciate that the invention is not limited to the specific embodiment described above. For example, it would be possible to carry out the installation method using more than one barge to support the offshore structure if so required, with respective parts of the structure arranged under respective barges. Also, for example, the counterweight need not take the particular form shown. For example, the base 4 may be of a generally constant thickness and suitably shaped to produce a counterweight effect.

What is claimed is:

1. A method of transporting an offshore structure to, and installing the structure at, a sea bed installation site comprising transporting the offshore structure to the installation site by a barge having a submerged portion with at least a portion of the structure being supported directly vertically under the submerged portion of the barge, and lowering the offshore structure in its installed orientation into its installation site on the sea bed wherein, prior to transporting the structure, the barge is floated into position over a part of the structure and the structure attached to the barge.

2. A method of transporting and installing an offshore structure as claimed in claim 1 wherein, after being positioned over the offshore structure, the barge is lowered onto a portion of the structure and the structure then fixed to the barge.

3. A method of transporting and installing an offshore structure as claimed in claim 2 wherein the offshore structure is constructed in a dry dock and the lowering of the barge is effected by ballasting the barge down to a base or at least partially emptying the dry dock.

4. A method of transporting and installing an offshore structure as claimed in claim 1 wherein the offshore structure is secured beneath the barge.

5. A method of transporting and installing an offshore structure as claimed in claim 4 wherein the offshore structure is tensioned against the barge.

6. A method of transporting and,installing an offshore structure as claimed in claim 1 wherein the offshore structure is attached to the barge using strand jacking means.

7. A method of transporting and installing an offshore structure as claimed in claim 6 wherein the offshore structure is lowered to the water bed using said strand jacking means.

8. A method of transporting and installing an offshore structure as claimed in claim 1 wherein the offshore structure comprises a base and a tower extending upwardly from the base.

9. A method of transporting and installing an offshore structure as claimed in claim 1 wherein the tower is offset from the centre of the base.

10. A method of transporting and installing an offshore structure as claimed in claim 9 wherein the tower is arranged at one end of the base.

11. A method of transporting and installing an offshore structure as claimed in claim 8 wherein the base comprises a counterweight displaced relative to the tower.

12. A method of transporting and installing an offshore structure as claimed in claim 11 wherein the counterweight is a concrete upstand extending upwardly from the base.

13. A method of transporting and installing an offshore structure as claimed in claim 12 wherein the tower and counterweight are spaced apart such that the barge may be positioned between them.

14. A method of transporting and installing an offshore structure as claimed in claim 8 wherein a positioning means is provided on the water bed such that guide means provided on the said positioning means engage with cooperating means provided on the base as the offshore structure is lowered to the water bed.

15. A method of transporting and installing an offshore structure as claimed in claim 14 wherein the positioning means is also installed prior to the installation of the offshored structure.

16. A method of transporting an offshore structure to, and installing the structure at, a sea bed installation site comprising transporting the offshore structure to the installation site by a barge having a submerged portion with at least a portion of the structure being supported directly vertically under the submerged portion of the barge, wherein the offshore structure is secured beneath and tensioned against the barge, and lowering the offshore structure in its installed orientation into its installation site on the sea bed.

17. A method of transporting and installing an offshore structure as claimed in claim 16 wherein the offshore structure is attached to the barge using strand jacking means.

18. A method of transporting and installing an offshore structure as claimed in claim 16 wherein the offshore structure is lowered to the water bed using said strand jacking means.

19. A method of transporting and installing an offshore structure as claimed in claim 16 wherein the offshore structure comprises a base and a tower extending upwardly from the base.

20. A method of transporting an offshore structure to, and installing the structure at, a sea bed installation site comprising transporting the offshore structure to the installation site by a barge having a submerged portion with at least a portion of the structure being supported directly vertically under the submerged portion of the barge, and lowering the offshore structure in its installed orientation into its installation site on the sea bed, wherein the offshore structure is attached to the barge using strand jacking means.

21. A method of transporting and installing an offshore structure as claimed in claim 20 wherein the offshore structure is lowered to the water bed using said strand jacking means.

22. A method of assembling, transporting and installing an offshore structure comprising:

bolting a tower of the offshore structure to a base of the offshore structure;

transporting the offshore structure to an installation site by barge with at least a portion of the offshore structure being supported directly vertically under the barge; and lowering the offshore structure to rest on a water bed at the installation site.

23. The method of claim 22, comprising bolting a bottom segment of the lower to the base and attaching further tower segments to said bottom segment.

* * * * *